US010443202B2

(12) United States Patent
Waxse

(10) Patent No.: US 10,443,202 B2
(45) Date of Patent: Oct. 15, 2019

(54) PILE DESIGN OPTIMIZATION

(71) Applicant: TERRACON, Olathe, KS (US)

(72) Inventor: Joseph A. Waxse, Olathe, KS (US)

(73) Assignee: TERRACON, Olathe, KS (US)

( * ) Notice: Subject to any disclaimer, the term of this patent is extended or adjusted under 35 U.S.C. 154(b) by 632 days.

(21) Appl. No.: 14/868,153

(22) Filed: Sep. 28, 2015

(65) Prior Publication Data

US 2016/0108598 A1 Apr. 21, 2016

Related U.S. Application Data

(60) Provisional application No. 62/066,884, filed on Oct. 21, 2014.

(51) Int. Cl.
*E02D 7/06* (2006.01)

(52) U.S. Cl.
CPC ..... *E02D 7/06* (2013.01); *E02D 2600/10* (2013.01)

(58) Field of Classification Search
CPC ..... E02D 13/00; E02D 13/06; E02D 7/02; E02D 7/06; E02D 2600/10; G01B 11/22; G01B 21/18
USPC ..... 173/2, 13, 30, 31, 50–51, 81–114, 117, 173/200–201, 206–209, 135–138, 212, 173/141–161, 184–189, 25–27, 213–222, 173/165; 227/119, 147; 405/232
See application file for complete search history.

(56) References Cited

U.S. PATENT DOCUMENTS 5,256,003 A * 10/1993 Ito ..... E02D 3/106 405/232
5,978,749 A * 11/1999 Likins, Jr. ..... E02D 13/00 700/108
7,575,398 B2 * 8/2009 Lloyd ..... E02D 11/00 405/232
2002/0103630 A1 * 8/2002 Aldred ..... E21B 44/00 703/10
2002/0148298 A1 * 10/2002 McVay ..... E02D 13/06 73/760
2005/0023014 A1 * 2/2005 Bermingham ..... E02D 7/02 173/2
2007/0074881 A1 * 4/2007 Bermingham ..... E02D 7/02 173/2
2010/0032165 A1 * 2/2010 Bailey ..... G06F 17/50 166/369

(Continued)

*Primary Examiner* — Robert F Long
(74) *Attorney, Agent, or Firm* — Shook, Hardy & Bacon

(57) ABSTRACT

Methods and systems for optimizing pile design based on pile driver data are provided. A pile driving performance monitoring (PDPM) system captures pile driver data for a pile in an identified location using a pile driver data capture device. The pile driver data comprises a pile penetration depth and pile penetration rate based on percussive hammer. The identified location can be determined using a global positioning system. A parsing program component analyzes the pile driver data for the pile. The parsing program component determines whether the pile driver data of the pile meets an anticipated-pile driving criteria, the anticipated-pile driving criteria comprises a test pile driver data that correlates with a predefined capacity for a pile in the identified location. The pile is added to an acceptance report when it meets the anticipated-pile driving criteria or added to exception report when it does not meet the anticipated-pile driving criteria.

10 Claims, 8 Drawing Sheets

(56) References Cited

U.S. PATENT DOCUMENTS

| | | | | |
|---|---|---|---|---|
| 2011/0100659 | A1* | 5/2011 | Murate | E02D 7/16<br>173/104 |
| 2011/0313724 | A1* | 12/2011 | Dalton | G01B 21/18<br>702/166 |
| 2014/0318864 | A1* | 10/2014 | Nield | E21B 41/00<br>175/40 |

* cited by examiner

PILE DESIGN OPTIMIZATION

CROSS-REFERENCE TO RELATED APPLICATIONS

This application claims priority to U.S. Provisional Application Ser. No. 62/066,884, filed Oct. 22, 2014, entitled "PILE DESIGN OPTIMIZATION" which is incorporated herein by reference in its entirety.

BACKGROUND

Piles generally refer to poles that are hammered into the ground to provide foundation support for buildings, bridges, and other structures. Piles safely transfer structural loads to the ground and avoid excess settlement or lateral movement. Pile design includes identifying information, such as, types of piles used, capacity requirements, minimum depths, and testing requirements for piles. Pile design systems provide ways of identifying suitable specifications for driving piles for different types of structures.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments described herein generally relate to optimizing pile design based on pile driver data. A pile driving performance monitoring (PDPM) system captures pile driver data for a pile in an identified location, using a pile driver data capture device. The pile driver data comprises a pile penetration depth and pile penetration rate based on a percussive hammer. The identified location can be determined using a global positioning system. A parsing program component analyzes the pile driver data for the pile. The parsing program component determines whether the pile driver data of the pile meets an anticipated-pile driving criteria, the anticipated-pile driving criteria comprises a test pile driver data that correlates with a predefined vertical capacity and lateral capacity for a pile in the identified location. The pile is added to an acceptance report when it meets the anticipated-pile driving criteria or the pile is added to exception report when it does not meet the anticipated-pile driving criteria.

BRIEF DESCRIPTION OF THE SEVERAL VIEWS OF THE DRAWING

Illustrative embodiments of the present invention are described in detail below with reference to the attached drawing figures, which are incorporated herein by reference, wherein.

DETAILED DESCRIPTION OF THE INVENTION

Figure 1A:
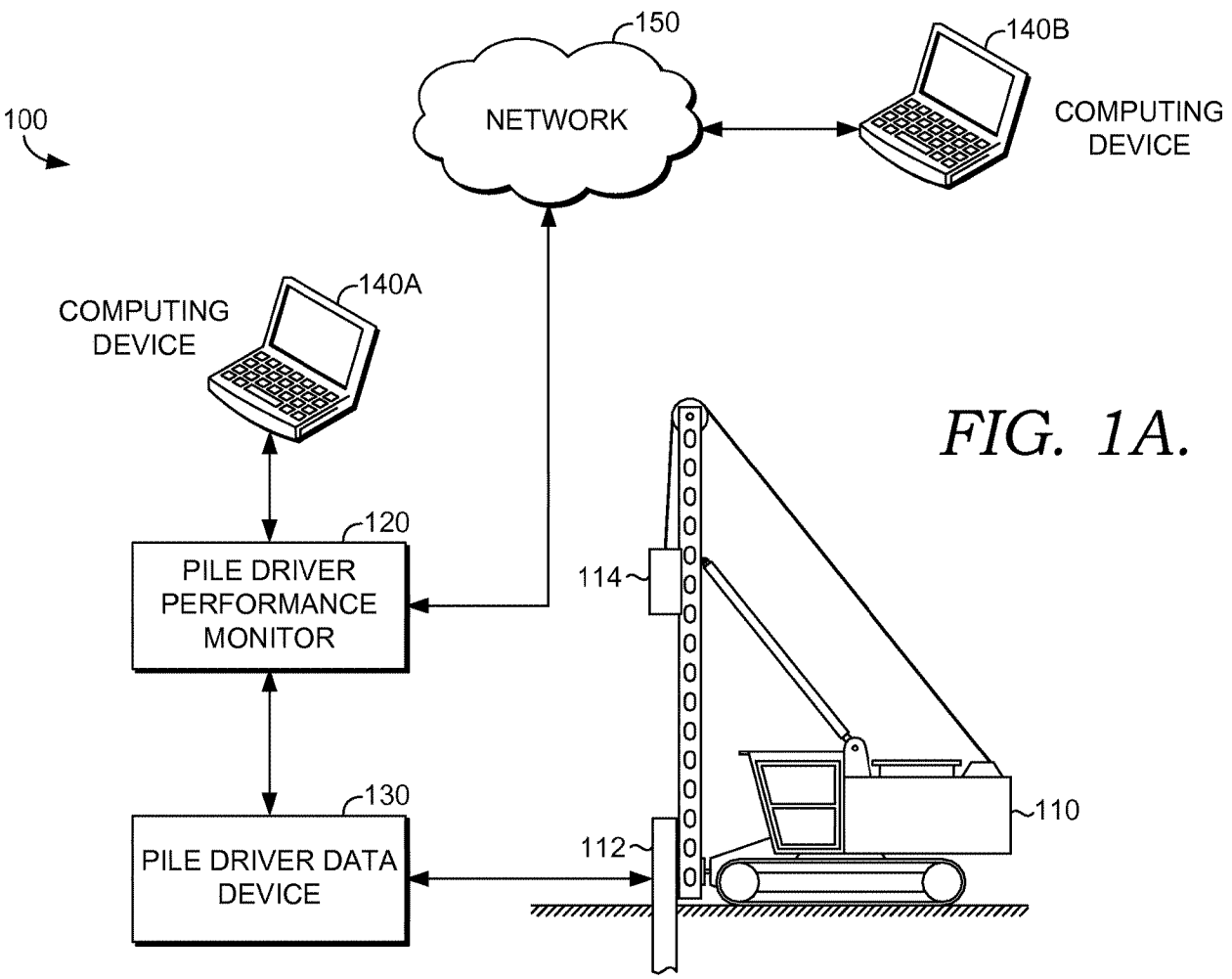
FIGS. 1A and 1B depict a block diagram of a pile design optimization system.

Pile design systems provide ways of identifying suitable locations for driving piles for different types of structures. Pile design uses pile driving monitoring or dynamic pile driving monitoring during a pre-construction test phase to help formulate pile driving criteria. During installation of production piles, pile driving monitoring can be used to help check that driving occurs according to the pile driving criteria. Pile driving monitoring can particularly give information on soil resistance at the time of monitoring. In operation, when a pile driving hammer impacts the pile top, accelerometers and strain gauges or transducers attached to the hammer, obtain data that is converted to velocity and force readings. In this regard, conventional pile driving monitoring are directed to particular types of measuring tools and measurements that are used in pile driving monitoring and pile design in general.

Embodiments of the present invention provide simple and efficient methods and systems for optimizing pile design based on pile driver data. Pile driver data generally refers to a pile penetration depth and a pile penetration rate of a pile being driven particularly using a percussive hammer at an identified location. Pile driver data can be captured using a pile driver data capture device that is operably coupled to a pile driver performance monitor (PDPM) system that receives and analyzes pile driver data of the percussive hammer. The pile driver data can be analyzed to determine whether the pile driver data associated with the pile meets predefined pile driving criteria. The predefined pile driving criteria include a test pile driver data that correlates with an accepted vertical pile capacity and lateral pile capacity. The predefined pile driving criteria can be determined based on pile load testing and additionally, engineering analysis.

When a pile meets the predefined pile driving criteria the pile can be added to an acceptance report with a summary of the driving characteristics of the pile. However, when the pile does not meet the predefined driving criteria, the pile can be added to an exception report. It is contemplated that proof testing and/or remedial measures can be determined based on the pile driver data and/or additional test pile driver data in a proximate location. Proof testing and remedial measures are recommended to address the exception status of the pile. When a satisfactory proof results or remedial measures are confirmed, the pile can be moved to the acceptance report.

In embodiments, load testing test piles on project sites can be performed prior to installing production piles. During this scenario, the PDPM can be installed on a pile driver (e.g., a drill rig with a percussive hammer) and the pile driver data capture device can be used to capture pile driver data that can provide advance information used in developing the pile driving criteria for surrounding anticipated-pile locations. Pile driver data can include the pile penetration depth and the pile penetration rate based on the percussive hammer. The pile driver data may also indicate the resistance of the pile location. The pile driver data information can be used to draw conclusions about soil composition. The pile driver data is also used to develop pile driving criteria for anticipated-piles in proximate locations of the test pile, prior to pile installation. The advance information can in particular be used to determine appropriate pile lengths for production piles. In this regard, the test pile driver data correlate with vertical capacity and lateral capacity for a pile. As such, at a high level, the pile driver data capture device captures pile drive data for test piles which can be used to confirm that production piles meet the predefined pile driving criteria for an identified location.

Accordingly, a first embodiment described herein is directed to a computer-implemented method for pile design optimization based on pile driver data. The method includes identifying a location to drive a pile. The method also includes determining that the location to drive the pile corresponds to an anticipated-pile location. The anticipated-pile location is associated with an anticipated-pile driving criteria. The method further includes capturing pile driver data for driving the pile at the location using a percussive hammer. The pile driver data comprises a pile penetration depth and a pile penetration rate based on the percussive hammer. The method includes analyzing the pile driver data to determine whether the pile driver data of the pile meets the anticipated-pile driving criteria. The anticipated-pile driving criteria comprise at least a test pile driver data that correlates with a predefined capacity for an anticipated-pile in the identified location. The method includes generating a report for the pile, the report is based on the analysis to determine whether the pile driver data meets one or more predefined pile driving criteria.

In a second embodiment described herein, a pile driver data capture device is provided. The pile driver data capture device includes a sensor that facilitates measuring pile driver data. The pile driver data comprises a pile penetration depth and a pile penetration rate based on consistent energy impacted on the pile by a percussive hammer of a pile driver. The device further includes a data logger that records the pile driver data over time using the sensor. The pile driver data capture device also includes a parsing program component that analyzes the pile driver data.

In a third embodiment described herein, a system for pile design optimization is provided. The system includes a percussive hammer of a pile driver configured for driving a pile using consistent energy of the percussive hammer that is based on a hammering frequency of the percussive hammer, the hammering frequency comprising the number of consistent blows of the percussive hammer for a defined period of time. The system also includes a pile driver data capture device operably attached to the pile driver, the pile driver comprises a sensor configured for detecting a position of the percussive hammer. The system also includes a parsing program component configured for receiving a plurality of test piles locations, capturing test pile driver data for each of the plurality of test piles, the test pile driver data comprises corresponding pile penetration depths and pile penetration rates based on the percussive hammer. The system further includes generating an anticipated-pile driving criteria for an anticipated-pile proximate to the plurality of test pile locations. The anticipated-pile driving criteria comprise an accepted vertical capacity and lateral capacity for the anticipated-pile in a corresponding test pile location.

Figure 1B:
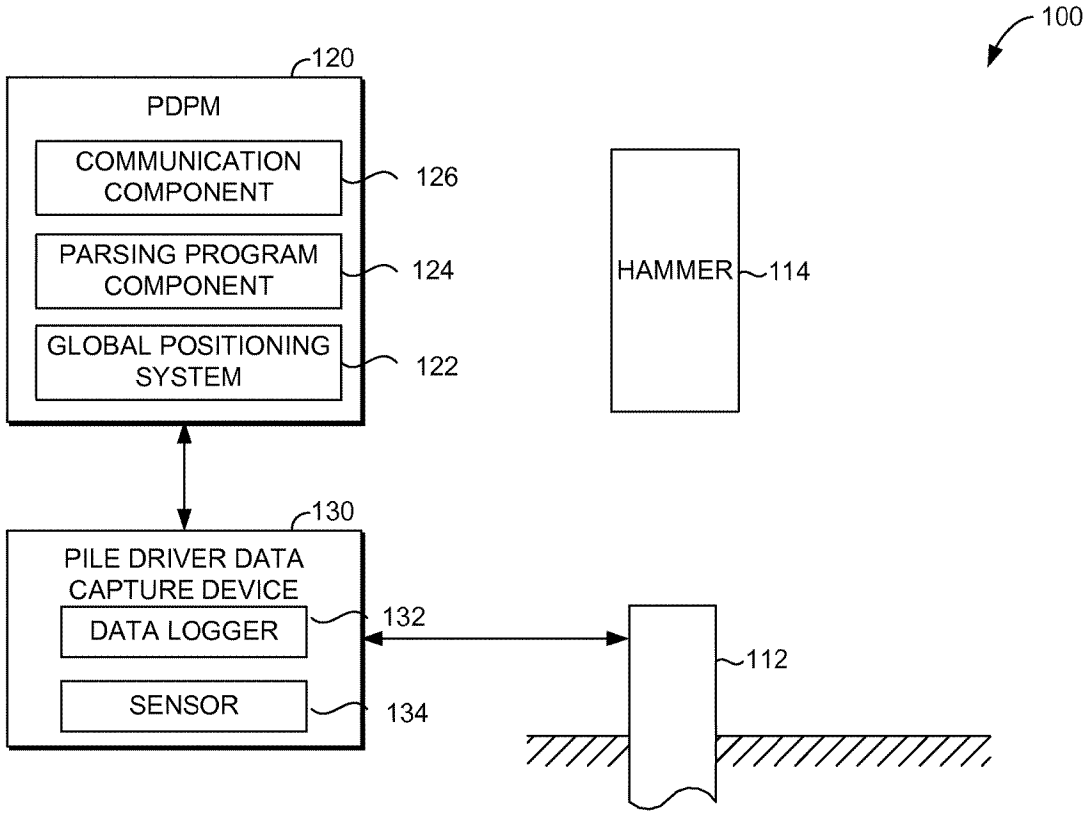
Figure 2:
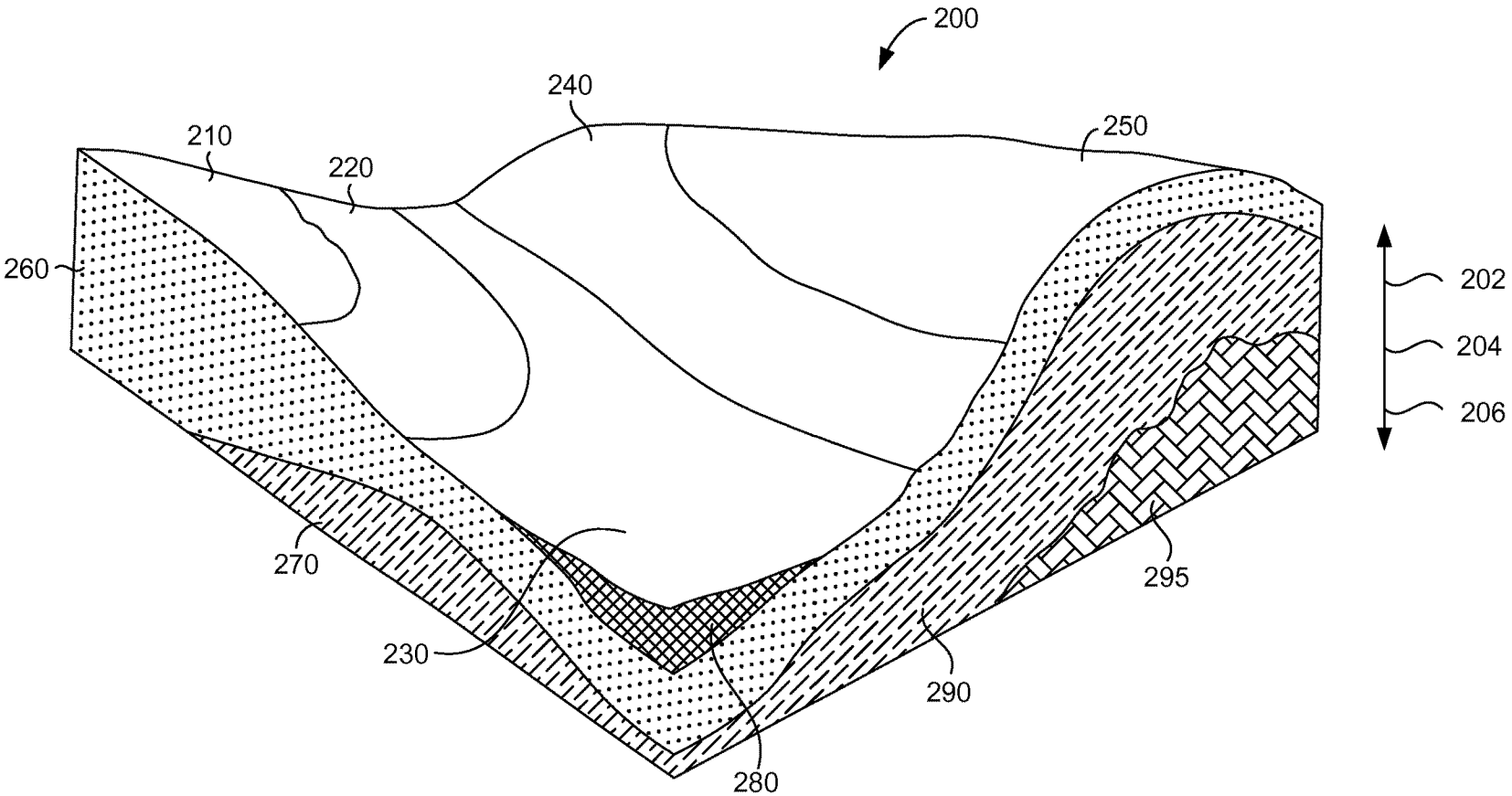
FIG. 2 depicts a schematic of soil composition in an exemplary project site.

Referring to FIGS. 1A and 1B, FIGS. 1A and 1B illustrate a pile design optimization operating environment 100. The pile design optimization operating environment 100 includes a pile driver 110 having an hammer, a pile 112, a pile driving performance monitoring (PDPM) system 120, a pile driver data capture device 130, a computing device 140A and 140B and a network 150. The network 150 may include, without limitation, one or more local area networks (LANs) and/or wide area networks (WANs). Such networking environments are commonplace in offices, enterprise-wide computer networks, intranets and the Internet. Accordingly, the network is not further described herein.

It should be understood that this and other arrangements described herein are set forth only as examples. Any number of computing devices may be employed in the environment 100 within the scope of embodiments of the present invention. Other arrangements and elements (e.g., machines, interfaces, functions, orders, and groupings of functions) can be used in addition to or instead of those shown, and some elements may be omitted all together. For example, other components/modules not shown also may be included within the environment 100.

Further, many of the elements described herein are functional entities that may be implemented as discrete or distributed components or in conjunction with other components, and in any suitable combination and location. Various functions described herein as being performed by one or more entities may be carried out by hardware, firmware, and/or software. For instance, various functions may be carried out by a processor executing instructions stored in memory.

The pile driver 100 generally refers to a mechanical device used to drive piles (poles) into soil to provide foundation support for building or other structures. A conventional pile driver includes a heavy weight (e.g., hammer 114) is placed between guides so that it is able to freely slide up and down in a single line. The hammer 114 is placed upon a pile 112. The hammer 114 is raised, which may involve the use of hydraulics, steam, diesel, or manual labor. When the hammer 114 reaches its highest point, the weight is then released and smashes onto the pile 112 in order to drive it into the ground. In embodiments described herein, the hammer is in particular a percussive hammer. In contrast to other types of hammers, the percussive hammer provides consistent energy impacted on the pile. The consistent energy is based on a hammering frequency of the percussive hammer indicating the number consistent blows of the percussive hammer for a defined period of time. The consistent blows can be measured or be determined based on manufacturer specifications for the hammering frequency. Other variations and combinations of ways of determining the hammer frequency and consistent energy are contemplated with embodiments of the present invention.

Advantageously, the consistent energy of percussive hammer is different from a broad range of energy that can be generated from other types of hammers. For example, a hydraulic hammer generates a broad range of energy based on the impact on the pile and corresponding resistance of the soil in which the pile is being driven into. In contrast, the percussive hammer provides a consistent energy output. In particular, the consistent energy is not dependent on the resistance of the soil but stays consistent and calculated as such. The consistent energy can be used to correlate a pile penetration depth with a pile penetration rate and used in identifying a predefined lateral capacity and vertical capacity for a pile in an identified location.

With continued reference to FIG. 1B, the PDPM system 120 of the pile driver 110 includes a global positioning system 122, a parsing program component 124, and a communication component 126, that in combination provide functionality to analyze pile driver data for a selected pile in an identified location. The PDPM system 120 is configured to capture the location of the pile driver using the global positioning system 122. The global positioning system is a space-based satellite navigation system that provides location information. Location information can be expressed in various types of units. For example, a specific location can be expressed in GPS coordinates, such that, individual locations can be captured and logged. In particular, the parsing program component 124 can reference a project master file. The project master file comprises GPS coordinates of identified locations (e.g., anticipated-pile locations) for driving piles. The parsing program component 125 determines that GPS coordinates, in the project master file, of a location to drive a pile correspond to current GPS coordinates of the pile driver. The parsing program may assign a location name of the location in the project master file to the pile driver data to correlate the pile driver data with the location.

The PDPM system 120 of the pile driver is configured reference the hammer status information of the hammer 114. The hammer status information can be determined using the pile driver data capture device 130 having a data logger 132 and a sensor 134. The pile driver data capture device is operably attached to the pile driver, the pile driver comprises a sensor 134 configured for detecting a position of the percussive hammer. The data logger 132 records the pile driver data over time using the sensor 134. The data logger 132 can refer to an electronic device that records data over time or in relation to a location of the percussive hammer associated with the sensor 134. By way of example, the hammer 114 can be raised to a predefined height in a particular location for driving a pile such that the data logger 132 starts recoding pile driver data for the location and height once the hammer 114 is driven below the height. The data logger 132 can include a digital processor that provides computing capacity and further operably coupled to the PDPM 120. The data logger 134 can include an internal memory for data storage and sensor. The data logger 132 can further interface with a computing device and/or PDPM 120 and utilize software to activate the data logger and view and analyze the collected data. In this regard, the pile driver data capture device 130 can provide hammer status information to the parsing program component 124 that analyzes the pile driver data.

The hammer status information includes information associated with the hammer position and whether the hammer is on or off. The hammer status information is captured to determine when to start capturing pile driver data. In operation, the parsing program component 120 detects and/or references via the pile driver data capture device 130 when the hammer is positioned to drive a pile. The parsing program can also determine the push depth based on the pile driver data capture device 130 data. The push depth refers to a depth to which the pile is pushed into the ground without the hammer being turned on. The parsing program component 120 can be configured to record the push depth, such that, the push depth can be accounted for during additional analysis as described in more detail herein. In embodiments, it is contemplated that the hammer may be stopped to re-level the pile or add the pile driving extension and then reactivated, as such, the parsing program component is further configured to resume accumulating the rate of pile penetration and pile penetration depth from the new position where the hammer was re-activated. The parsing program component can capture the data based on the pile driver data capture device 130 until the hammer is raised into position for the next pile.

An operator of the pile driver can turn on the hammer. Upon turning on or activating the hammer, the parsing program component can capture pile driver data. The pile driver data refers to the pile penetration depth and the pile penetration rate based on a percussive hammer. The pile penetration rate and a cumulative pile penetration depth can be captured until the hammer is turned off.

The computing devices 140A and 140B may include any type of computing device 500 described below with reference to FIG. 5, for example. The computing devices 140A and 140B can provide access to the PDPM 120 and pile driver data capture device 130. Access to the PDPM 120 in particular can be provided using a communication component 126. PDPM system 120 includes the communication component 126 for communicating the pile driver data and analysis information. The communication component 126 can provide several different types communication mechanisms for transferring data between the components described herein. For example, an Internet Protocol (IP) address may be configured for accessing the pile driver data captured. The computing devices can perform additional analysis on the pile driver data, and further communicate results data based on the analysis, to the PDPM for application. For example, the computing device may include supplemental engineering tools, resources, and databases that can be used to analyze the pile driver data to generate results.

In operation, a test pile can be used to identify test pile driver data. The test pile driver data can be evaluated using the computing device having engineering tools, resources, and tools to determine pile driving criteria for anticipated-piles proximate to the test pile location. In embodiments, the pile driver data can be used to identify soil composition information based on the pile penetration depth and the pile penetration rate. Specifically, pile penetration rate can be correlated to different pile penetration depths such that certain assumptions can be made of the soil composition. Analysis results can be generated, and in particular include a lateral capacity and a vertical capacity of the pile. The test pile driver data and the identified lateral capacity and vertical capacity of the pile can be used to predefine driving criteria for an anticipated-pile proximate the test pile location. In this regard, the pile driving criteria comprises pile driving data to be expected from an anticipated-pile location, the pile driving data correlates with an expected pile capacity (e.g., vertical and lateral capacity) determined at least in part of the test pile location calculated capacity. The computing devices can be configured to communicate the results data via the communication component 260 to the PDPM such that upon installation of production pile the results data can be used for determining whether the production pile meets the predefined driving criteria.

The parsing program component can be further configured to analyze the pile driver data to determine whether the pile drive data meets pile driving criteria. Pile driving criteria comprises test pile data that correlates with a predefined vertical and lateral pile capacity for a pile based on the pile load testing and engineering analysis. In operation, the parsing program component may reference the pile driver data. When it is determined that a selected pile meets a predefined criteria, the pile is added to an acceptance report with a summary of the pile driver data. The pile driver data can further include additional pile driving characteristics captured by the pile driver data capture device on a corresponding test pile. When it is determined that the selected pile does not meet any of the established set of criteria, the selected pile is added to an exception report. It is contemplated that for a selected pile in the exception report, proof testing or remedial measures can be recommended to address the exception status. When satisfactory proof test results or remedial measures are confirmed, the pile may be added to the acceptance report.

With reference to FIGS. 2 and 3A-3C an exemplary project site 200 and project site 300 are illustrated. A project site can be used for developing buildings, bridges, installing solar panels, and other types of structures. Project site 300 in particular illustrates top layer subsections 210, 220, 230, 240, and 250 of a project site and bottom layer subsections 260, 270, 280, 290, and 295. The top layer subsections and bottom layer subsections can be identified based on several different types of methods. For example, soil surveys that produce soil maps can be used to identify different bottom layer subsections. In addition, soil samples can be taken to identify different soil compositions of different areas. Other types of methods are contemplated for determining the actual composition of soil in different areas of a project site. Based on soil composition information, a project may be divided into top layer subsections where the top layer sections are expected to have substantially consistent bottom layer subsections. In this regard, test piles can be driven into top layer sections with the expectation of consistent pile driving criteria for anticipated piles proximate the test piles.

Figure 3A:
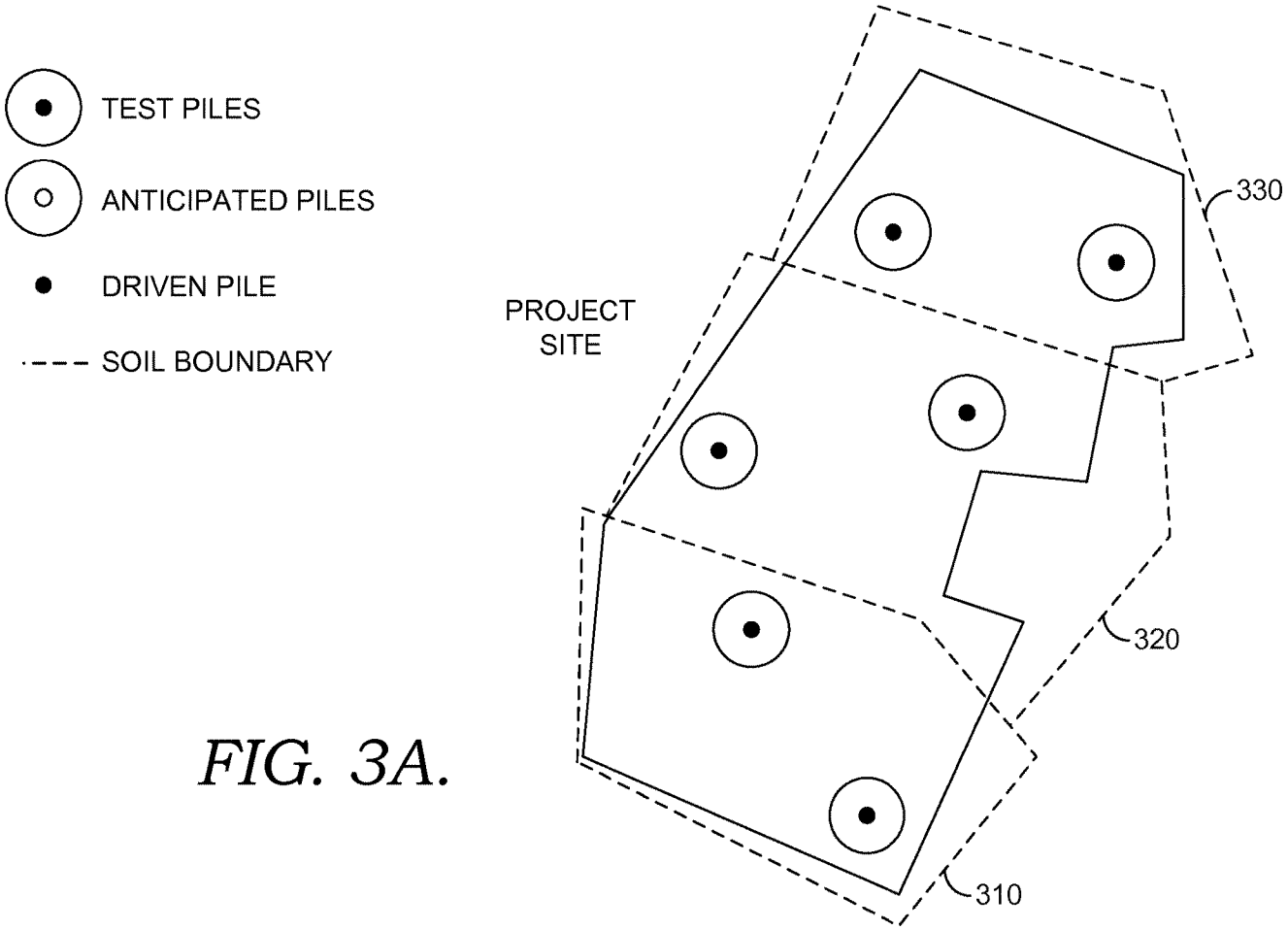
FIGS. 3A, 3B, and 3C depict schematics of a project site with different piles.
Figure 3B:
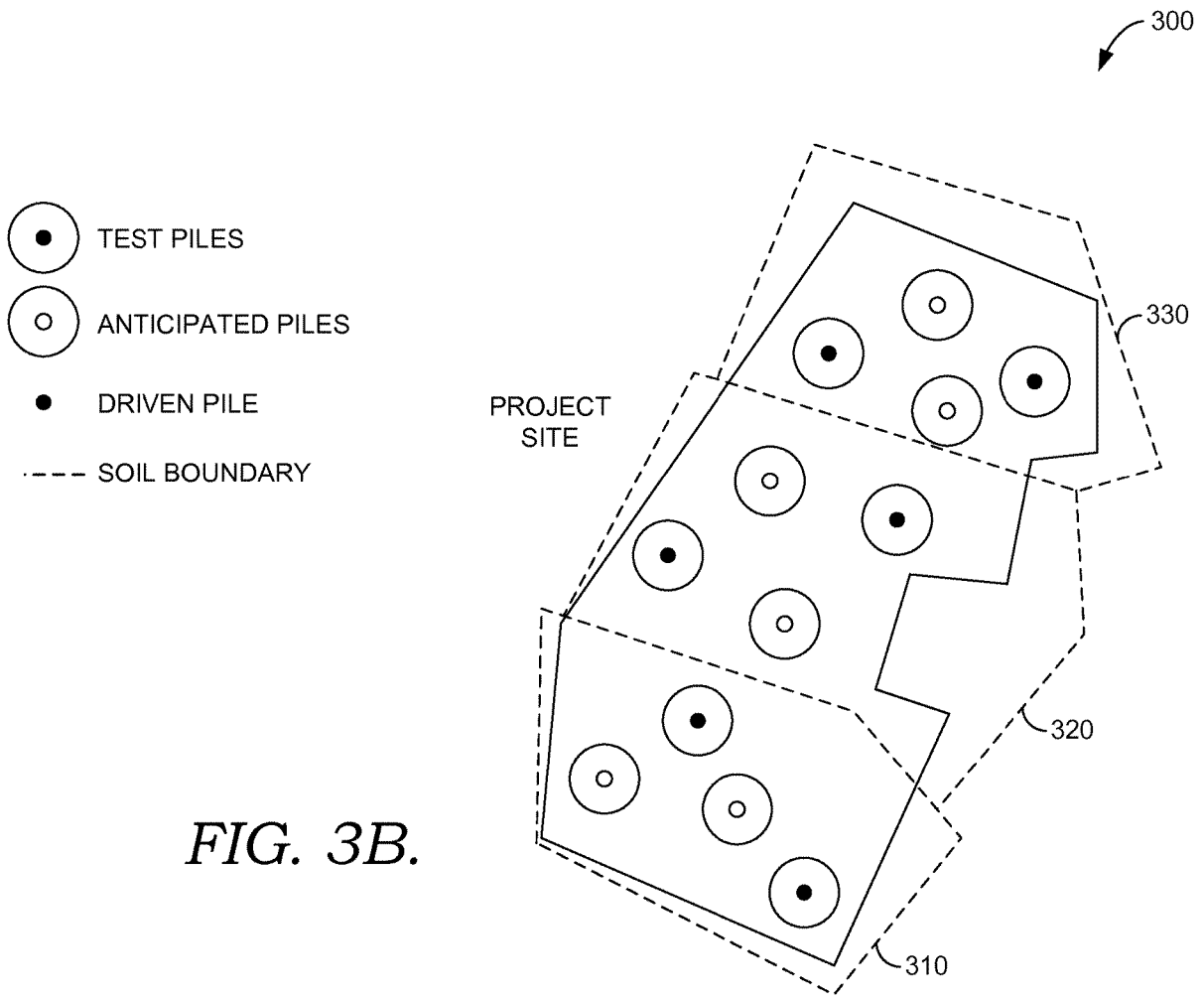
Figure 3C:
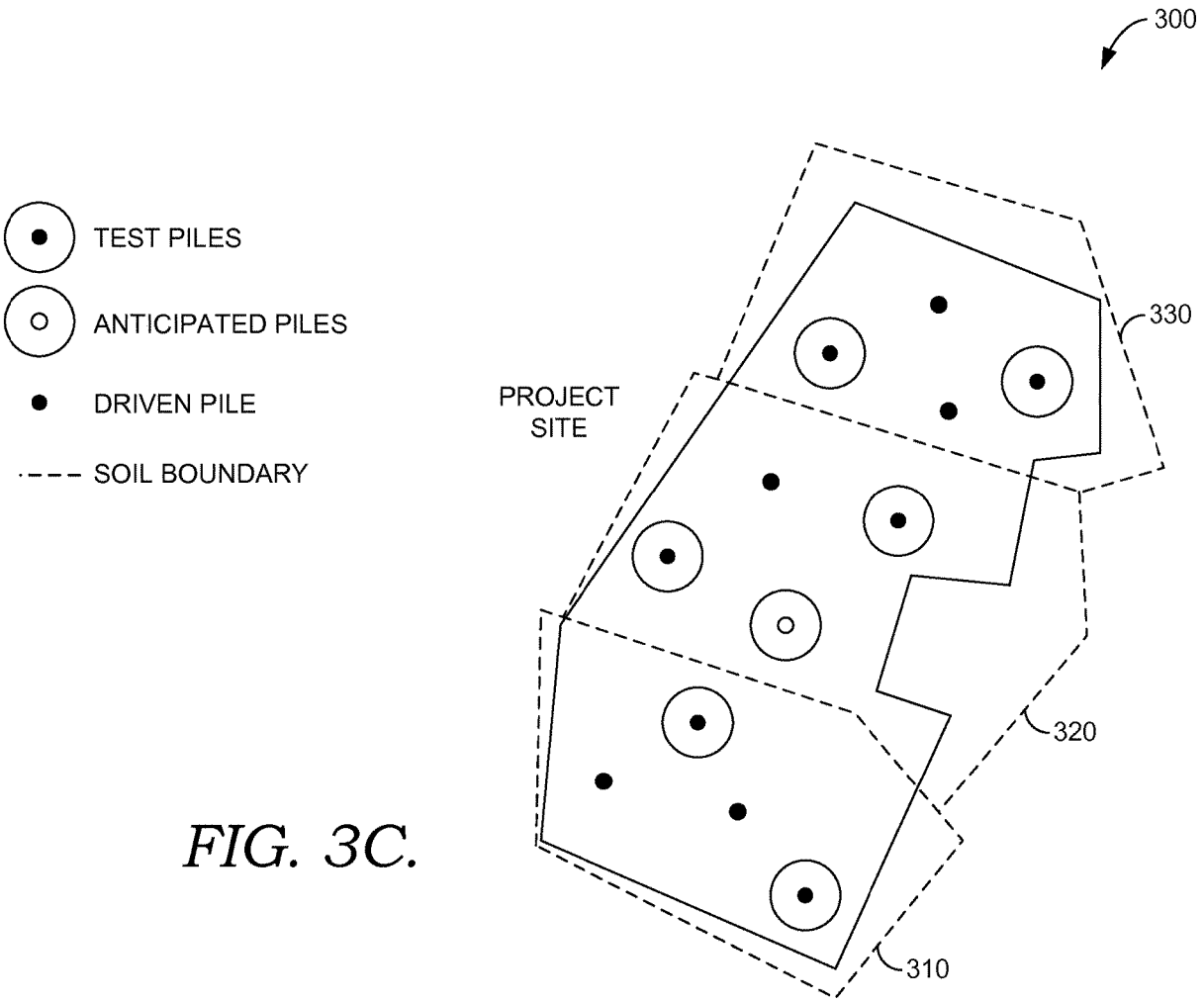

With reference to FIGS. 3A and 3B, the project site 300 is illustrated with three top layer subsections 310, 320, 330. As discussed above, the top layer subsections can be identified based on an expected consistent bottom layer subsections. As such, a boundary can be identified between top layer subsections as the underlying soil composition changes between subsections. Pile design optimization, in embodiments described herein, includes identifying a plurality of test pile locations and installing test piles using methods described herein. In particular, the test piles are installed using a percussive hammer that provides consistent energy based on a hammer frequency. Pile driver data that includes a pile penetration depth and a pile penetration rate is determined for the percussive hammer. The pile driver data can be correlated with a lateral capacity and vertical capacity for the pile in that location (e.g., subsection 310, 320, and 330).

In embodiments, the capacity information can be determined based on different depth levels of pile depth penetration in that the pile depth can correspond with different rates of penetration as the pile is driven through different levels of soil composition. With continued reference to FIG. 2, a pile penetration rate can be associated with a particular penetration depth (e.g., 202, 204, 206). The percussive hammer consistent energy can be correlated with a different pile penetration rates at different penetration depths. As such, the pile driver data can be used to determine soil composition. Further, the information of the pile penetration rates and soil composition can be used to identify a lateral capacity and vertical capacity of a test pile. And as described herein, the test pile data can in turn be used to define an anticipated-pile driving criteria and used determine whether anticipated-pile meets the predefined criteria.

The test pile driver data that correlates with the capacity information can be used to predefine pile driving criteria for anticipated-piles in the different subsections. The anticipated-piles can have pile driving criteria that correspond with proximate test piles that have pile driving criteria. Pile driving data can be captured for the anticipated-piles in the locations proximate to the test piles. The pile driving data for a driven anticipated-pile can be compared to the pile driver data of the test pile to draw certain conclusions about the driven anticipated-pile. By way of example, when the pile driving data of the anticipated-pile is consistent with the test pile a presumption can be made that the lateral capacity and the vertical capacity of the driven anticipated-pile can be substantially the same.

Similarly, if there is additional resistance in driving an anticipated-pile but a pile penetration depth is still achieved a conclusion can be drawn that the anticipated-pile meets the pile driving criteria. If a pile depth penetration depth cannot be reached or the penetration rate is significantly faster for an anticipated-pile, a conclusion can be drawn that the anticipated-pile does not meet the pile driving criteria. As such, remedial measures, as described above, may be implemented to further evaluate the driven anticipated-pile. Other variations and combinations of conclusions based on comparing pile driving data of a test pile driven using percussive hammering to pile driving data of a driven anticipated-pile also using percussive hammering are contemplated with embodiments described herein.

Figure 4:
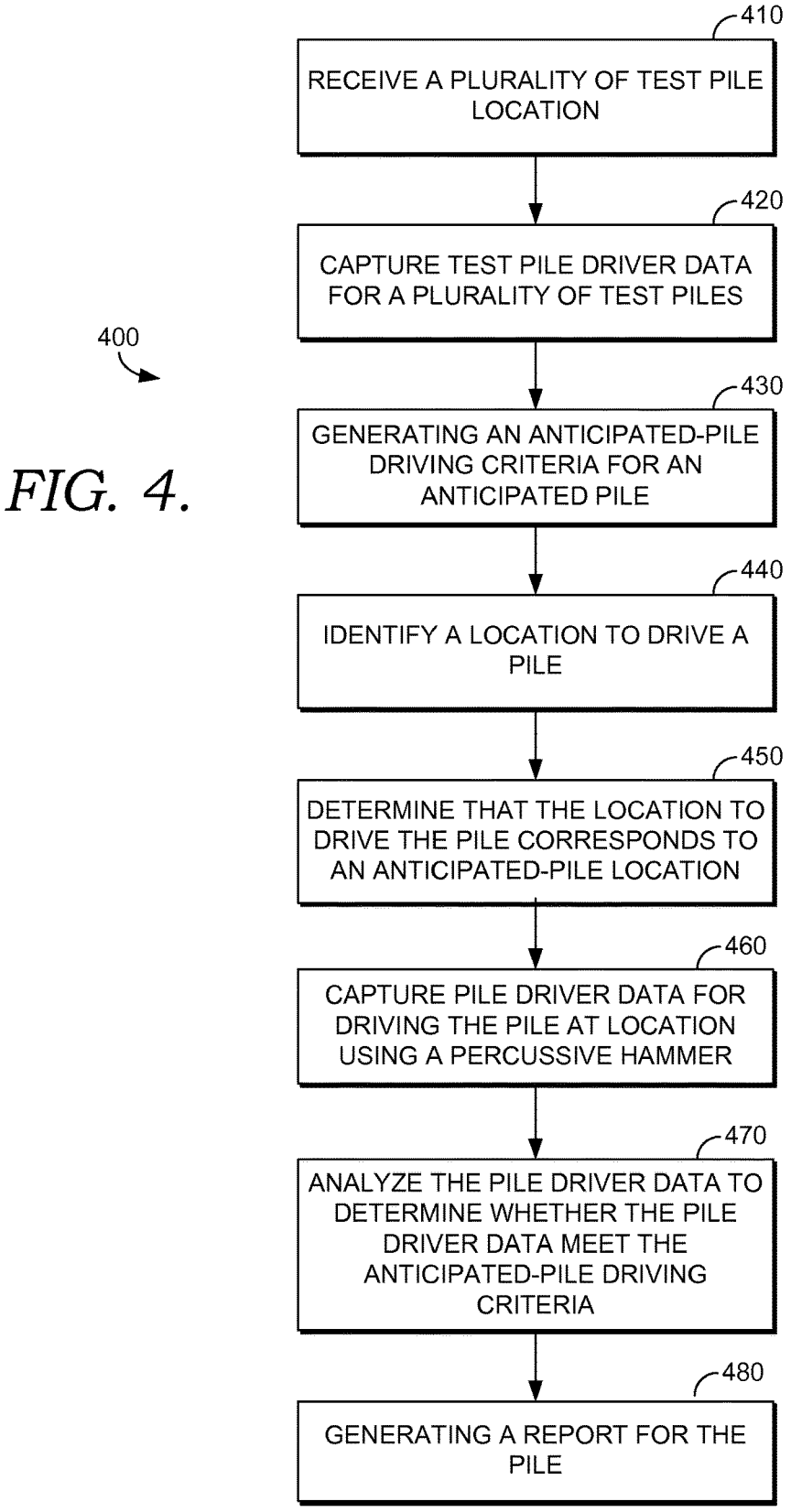
FIG. 4 depicts a flow diagram including steps of a method that is carried out in accordance with an embodiment described herein.

With reference to FIG. 4, a computer-implemented method 400 for pile design optimization is illustrated. Initially at block 410, a plurality of test piles locations is received. The test pile locations may be associated with a project site (e.g., project site 300). The test pile location may be specifically selected based on preliminary analysis of soil composition information of the project site. In this regard, a plurality of test pile locations can be identified for different soil composition subsections of a project site for generating pile driving criteria for a plurality of production piles to be identified in the project site. At block 420, test pile driver data can be captured for each of the plurality of test piles, the test pile driver data comprises corresponding pile penetration depths and pile penetration rates based on percussive hammer. As discussed above, the percussive hammer provides consistent energy as the percussive hammer impacts the pile, such that, the pile penetration depth and the pile penetration rate can be correlated together. In embodiments, the specific levels of the pile penetration depth and the pile penetration rates can be correlated to help determine the capacity at each level. It is contemplated that the correlations can also be used to make assumptions about the composition of the soil.

At block 430, an anticipated-pile driving criteria is generated for an anticipated-pile in the plurality of test pile locations. The anticipated-pile driving criteria comprise test pile driver data that correlates with an accepted vertical capacity and lateral capacity for a pile in the corresponding test pile location. The anticipated-pile driving criteria can also specifically include the expected penetration depth and penetration rate that was used to define the accepted vertical capacity and lateral capacity for the pile in the test pile location which is proximate to the anticipated-pile location. In operation, an anticipated-pile location may be identified in a location proximate a test pile location. Based in part of the proximity of the test pile location an assumption can be made that soil composition is similar and, as such, if similar pile driving data are experienced, the lateral capacity and vertical capacity for the anticipated-pile in the location proximate to the test pile can be corresponding.

At block 440, a production pile driving phase includes identifying a location to drive a pile. As discussed, upon completing a plurality of test piles for a project site, a plurality of production piles can be installed. In this regard, a location of the pile driver can be determined. The location can be determined using a global positioning system that is associated with the pile driver. The global positioning system can indicate specific coordinates of the location of the pile driver. At block 450, a determination is made that the location to drive the pile corresponds to an anticipated-pile location. The anticipated-pile location is associated with an anticipated-pile driving criteria based on a test pile driving criteria, where a location of the text pile is proximate a location of the anticipated-pile.

In embodiments, it is contemplated that a hammer status can be determined. The hammer status at least indicates whether the hammer is activated. When the hammer is activated, at block 460, pile driver data is captured at the location. The pile driver data comprises a pile penetration depth and a pile penetration rate based on the percussive hammer of the pile driver. At block 470, the pile driver data is analyzed to determine whether the pile driver data of the pile meets the anticipated-pile driving criteria. The anticipated-pile driving criteria comprise test pile driver data that are correlated with at least a predefined vertical capacity and horizontal capacity for an anticipated-pile in the identified location. At block 480, an acceptance report or an exception report is generated for the pile. The report is based on the analysis to determine whether the pile driver data meets one or more predefined driving criteria. In embodiments, the pile in the exception report can trigger remedial measures for the pile, such that, a remedial test pile is driven to capture remedial test pile driver data. The remedial test pile is utilized in providing an accepted vertical capacity and lateral capacity for the pile.

Having briefly described an overview of embodiments of the present invention, an exemplary operating environment in which embodiments of the present invention may be implemented is described below in order to provide a general context for various aspects of the present invention. Referring initially to FIG. 5 in particular, an exemplary operating environment for implementing embodiments of the present invention is shown and designated generally as computing device 500. Computing device 500 is but one example of a suitable computing environment and is not intended to suggest any limitation as to the scope of use or functionality of the invention. Neither should the computing device 500 be interpreted as having any dependency or requirement relating to any one or combination of components illustrated.

The invention may be described in the general context of computer code or machine-useable instructions, including computer-executable instructions such as program modules, being executed by a computer or other machine, such as a personal data assistant or other handheld device. Generally, program modules including routines, programs, objects, components, data structures, etc. refer to code that perform particular tasks or implement particular abstract data types. The invention may be practiced in a variety of system configurations, including hand-held devices, consumer electronics, general-purpose computers, more specialty computing devices, etc. The invention may also be practiced in distributed computing environments where tasks are performed by remote-processing devices that are linked through a communications network.

Figure 5:
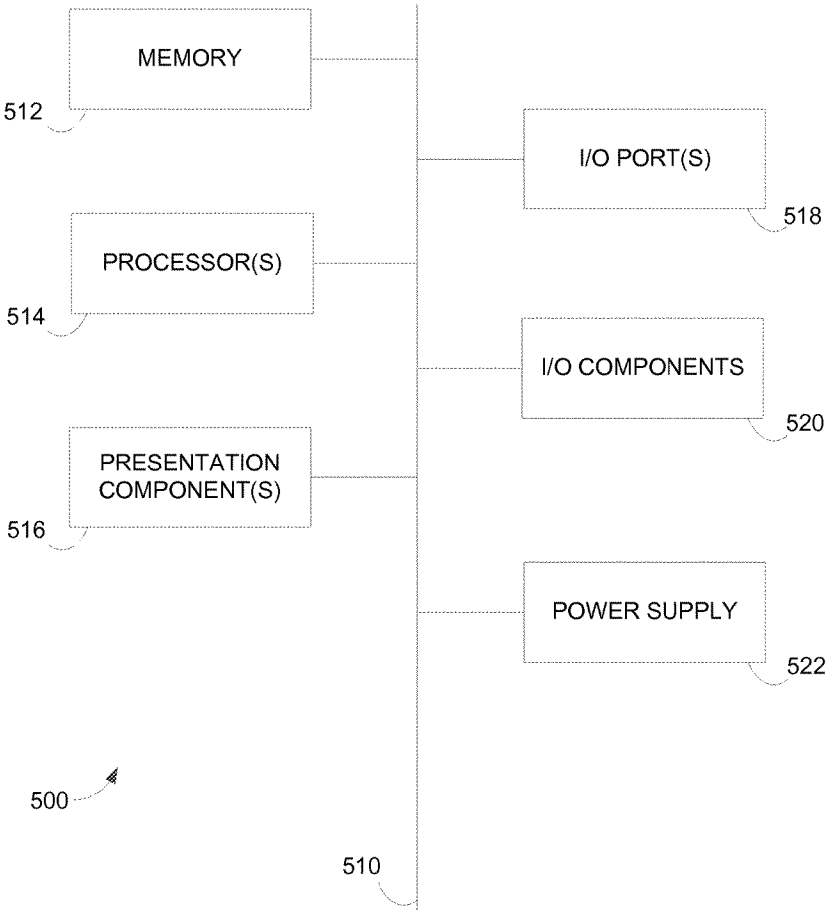
FIG. 5 is a block diagram of an exemplary computing environment suitable for use in implementing embodiments of the present invention.

With reference to FIG. 5, computing device 500 typically includes a variety of computer-readable media. Computer-readable media can be any available media that can be accessed by computing device 500 and includes both volatile and nonvolatile media, removable and non-removable media. By way of example, and not limitation, computer-readable media may comprise computer storage media and communication media.

Computer storage media include volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computing device 500. Computer storage media excludes signals per se.

Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 512 includes computer storage media in the form of volatile and/or nonvolatile memory. The memory may be removable, non-removable, or a combination thereof. Exemplary hardware devices include solid-state memory, hard drives, optical-disc drives, etc. Computing device 500 includes one or more processors that read data from various entities such as memory 512 or I/O components 520. Presentation component(s) 516 present data indications to a user or other device. Exemplary presentation components include a display device, speaker, printing component, vibrating component, etc. I/O ports 518 allow computing device 500 to be logically coupled to other devices including I/O components 520, some of which may be built in. Illustrative I/O components 520 include a microphone, joystick, game pad, scanner, hard/soft button, touch screen display, etc.

Embodiments of the present invention have been described in relation to particular embodiments which are intended in all respects to be illustrative rather than restrictive. Alternative embodiments will become apparent to those of ordinary skill in the art to which the present invention pertains without departing from its scope.

From the foregoing, it will be seen that this invention in one well adapted to attain all the ends and objects hereinabove set forth together with other advantages which are obvious and which are inherent to the structure.

It will be understood that certain features and sub-combinations are of utility and may be employed without reference to other features or sub-combinations. This is contemplated by and is within the scope of the claims.

The invention claimed is:

1. A pile driver data capture device comprising computing components, a sensor, a data logger, the data logger is communicatively coupled to a parsing program component in a computing device operating as a data acquisition system, the pile driver data capture device operably attached to a pile driver for capturing pile driver data for a percussive hammer, the device comprising:

the sensor that measures pile driver data, wherein the pile driver data includes a pile penetration depth and a pile penetration rate based on consistent energy impacted on a pile by the percussive hammer of the pile driver;

the data logger that records the pile driver data for a defined period of time using the sensor, wherein the pile driver data correlates with a vertical capacity and a lateral capacity for the pile;

the parsing program component configured to:

capture the pile driver data for driving an anticipated-pile at an anticipated-pile location, wherein capturing the pile driver data comprises using anticipated-pile driver criteria to compare and correlate the pile driver data to the anticipated-pile driving criteria;

analyze the pile driver data to determine whether the pile driver data meets the anticipated-pile driving criteria, wherein the anticipated-pile driving criteria comprises at least a test pile driver data that correlates with a predefined capacity for driving the anticipated-pile in the anticipated-pile location; and generates a report, wherein the report is based on the analysis to determine whether the pile driver data meets the anticipated-pile driving criteria.

2. The pile driver data capture device of claim 1, wherein the pile driver data capture device is retrofitted into the pile driver.

3. The pile driver data capture device of claim 2, wherein the sensor is removeably or permanently attached to the pile driver to capture a position of the percussive hammer, wherein the position of the percussive hammer is used to indicate at least one of: a push depth of the pile and the pile penetration depth.

4. The pile driver data capture device of claim 1, wherein the data logger records the consistent energy of the percussive hammer, wherein the consistent energy is based on a hammering frequency of the percussive hammer, the hammering frequency indicating a number of consistent blows of the percussive hammer for the defined period of time.

5. The pile driver data capture device of claim 1, wherein the computing device comprises one or more hardware processors and memory storing computer-executable instructions and components embodied thereon that, when executed, by the one or more hardware processors, cause the hardware processors to execute the computer-executable instructions and components, wherein the parsing program component analyzes the pile driver data.

6. A system for pile design optimization, including a pile driver data capture device operably coupled to a percussive hammer, the pile driver data capture device further communicatively coupled to a parsing program component in a pile driver performance monitor, the system comprising:

the percussive hammer of the pile driver configured for:

driving a pile using consistent energy of the percussive hammer wherein the consistent energy is based on a hammering frequency of the percussive hammer, the hammering frequency indicating a number of consistent blows of the percussive hammer for a defined period of time;

the pile driver data capture device configured for:

detecting a position of the percussive hammer;

measuring pile driver data, wherein the pile driver data includes a pile penetration depth and a pile penetration rate based on the consistent energy impacted on the pile; and recording the pile driver data over the defined period of time; and the system further comprising one or more hardware processors and memory storing computer-executable instructions and components embodied thereon that, when executed, by the one or more hardware processors, cause the hardware processors to execute the parsing program component configured for:

receiving a plurality of test pile locations;

capturing test pile driver data for each of a plurality of test piles, wherein the test pile driver data comprises corresponding pile penetration depths and pile penetration rates;

generating an anticipated-pile driving criteria for an anticipated-pile in the plurality of test pile locations, wherein the anticipated-pile driving criteria comprises at least a test pile driver data that correlates with a vertical capacity and lateral capacity for a pile in the corresponding test pile location;

capturing pile driver data for driving the anticipated-pile at an anticipated-pile location, wherein capturing the pile driver data comprises using the anticipated-pile driver criteria to compare and correlate the pile driver data to the anticipated-pile driving criteria;

analyzing the pile driver data to determine whether the pile driver data meets the anticipated-pile driving criteria, wherein the anticipated-pile driving criteria comprises at least a test pile driver data that correlates with a predefined capacity for driving the anticipated-pile in the anticipated-pile location; and generating a report, wherein the report is based on the analysis to determine whether the pile driver data meets the anticipated-pile driving criteria.

7. The system of claim 6, wherein the pile driving performance monitor is configured for identifying soil composition information for the plurality of test piles based on the test pile driver data.

8. The system of claim 7, wherein the pile driving performance monitor is further configured for receiving anticipated-pile driving criteria for a plurality of anticipated-piles, wherein the anticipated-pile driving criteria is based at least in part on the soil composition information.

9. The system of claim 6, wherein the parsing program component is further configured for:

identifying a location to drive a pile;

determining that the location to drive the pile corresponds to the anticipated-pile location, wherein the anticipated-pile location is associated with the anticipated-pile driving criteria;

determining a hammer status, wherein the hammer status at least indicates whether the hammer is activated;

when the hammer is activated, capturing pile driver data at the location, wherein the pile driver data comprises the pile penetration depth and the pile penetration rate;

analyzing the pile driver data to determine whether the pile driver data of the pile meets the anticipated-pile driving criteria, wherein the anticipated-pile driving criteria comprises at least a test pile driver data that corresponds with a predefined vertical capacity and horizontal capacity for an anticipated-pile in the identified location; and generating an acceptance report or an exception report for the pile, wherein the report is based on the analysis to determine whether the pile driver data meets one or more predetermined criteria.

10. The system of claim 9, wherein the pile in the exception report triggers remedial measures for the pile, such that a remedial test pile is driven to capture remedial test pile driver data, wherein the remedial test pile is utilized in providing an accepted vertical capacity and lateral capacity for the pile.

* * * * *